US006149800A

United States Patent [19]

Iaccino et al.

[11] Patent Number: 6,149,800

[45] Date of Patent: Nov. 21, 2000

[54] PROCESS FOR INCREASED OLEFIN YIELDS FROM HEAVY FEEDSTOCKS

[75] Inventors: Larry Lee Iaccino, Friendswood; Nicolas P. Coute, Houston, both of Tex.

[73] Assignee: Exxon Chemical Patents Inc., Houston, Tex.

[21] Appl. No.: 09/257,168

[22] Filed: Feb. 24, 1999

Related U.S. Application Data

[62] Division of application No. 08/701,927, Aug. 23, 1996, Pat. No. 5,906,728.

[51] Int. Cl.[7] ..... C10G 65/12

[52] U.S. Cl. ..... 208/61; 208/89; 208/57; 208/62; 208/60; 208/66; 208/107

[58] Field of Search ..... 208/61, 89, 57, 208/62, 60, 66, 107

[56] References Cited

U.S. PATENT DOCUMENTS

| | | | |
|---|---|---|---|
| 2,282,451 | 5/1942 | Brooks | 280/61 |
| 2,801,208 | 7/1957 | Horne et al. | 208/61 |
| 3,147,210 | 9/1964 | Hass et al. | 208/210 |
| 3,535,231 | 10/1970 | Kittrell | 208/60 |
| 3,576,736 | 4/1971 | Kittrell | 208/60 |
| 3,617,485 | 11/1971 | Kittrell | 208/59 |
| 3,728,251 | 4/1973 | Kelley et al. | 208/89 |
| 3,767,562 | 10/1973 | Sze et al. . | |
| 3,826,736 | 7/1974 | Kittrell | 208/59 |
| 3,898,299 | 8/1975 | Jones . | |
| 4,061,562 | 12/1977 | McKinney et al. . | |
| 4,619,757 | 10/1986 | Zimmermann . | |
| 5,906,728 | 5/1999 | Iaccino et al. | 208/61 |

*Primary Examiner*—Hien Tran
*Assistant Examiner*—Nadine Presich

[57] ABSTRACT

A process for upgrading petroleum feedstocks boiling in the distillate plus range, which feedstocks, when cracked, result in unexpected high yields of olefins. The feedstock is hydroprocessed in at least one reaction zone countercurrent to the flow of a hydrogen-containing treat gas. The hydroprocessed feedstock is then subjected to thermal cracking in a steam cracker or to catalytic cracking in a fluid catalytic cracking process. The resulting product slate will contain an increase in olefins compared with the same feedstock, but processed in by a conventional co-current hydroprocessing process.

20 Claims, 1 Drawing Sheet

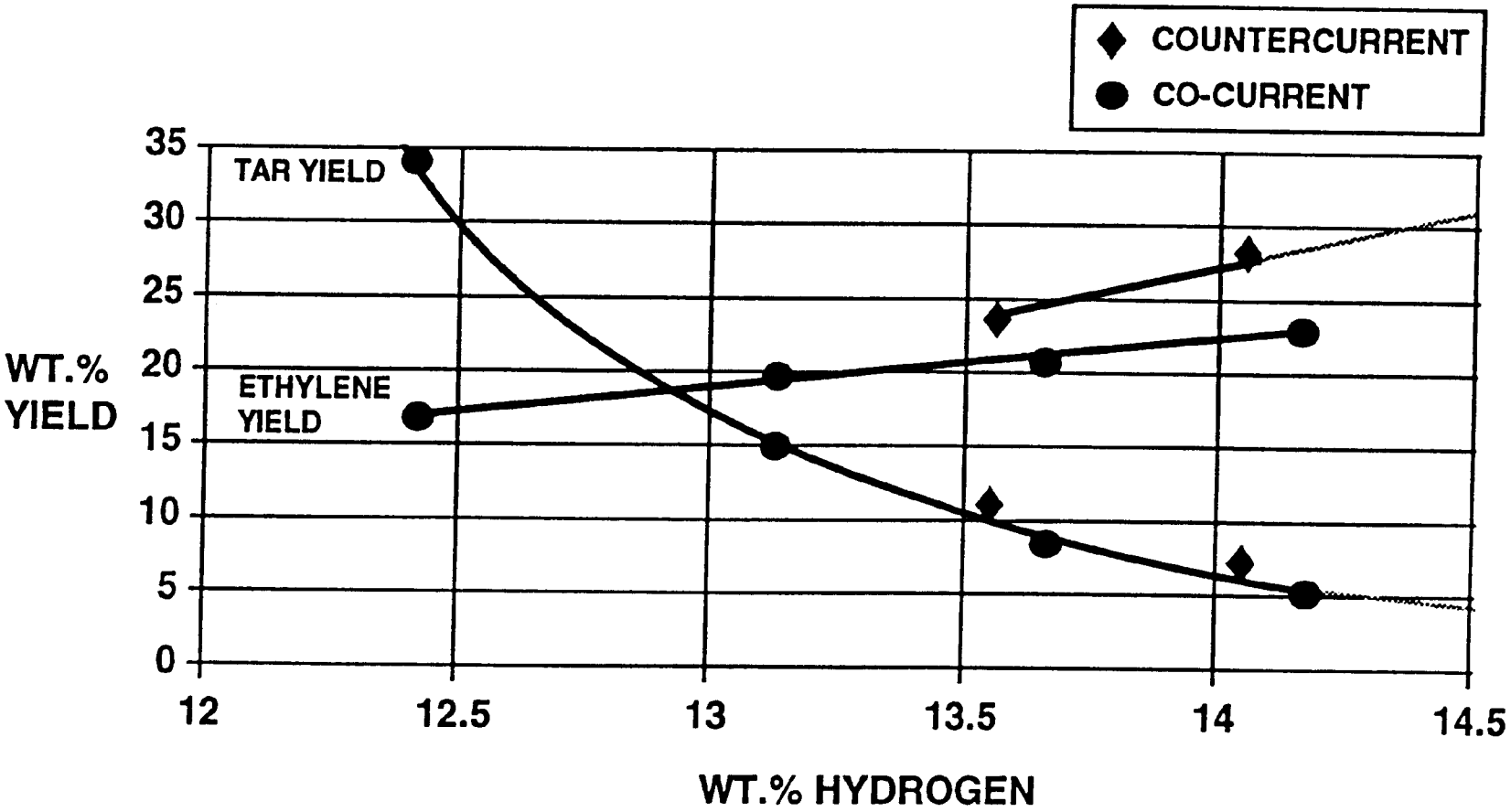
COUNTERCURRENT
CO-CURRENT
TAR YIELD
ETHYLENE YIELD
WT.% YIELD
35
30
25
20
15
10
5
0
12
12.5
13
13.5
14
14.5
WT.% HYDROGEN

PROCESS FOR INCREASED OLEFIN YIELDS FROM HEAVY FEEDSTOCKS

CROSS-REFERENCE TO RELATED APPLICATION

This is a division of application Ser. No. 08/701,927, filed Aug. 23, 1996, now U.S. Pat. No. 5,906,728.

FIELD OF THE INVENTION

The present invention relates to a process for upgrading petroleum feedstocks boiling in the distillate plus range, which feedstocks, when cracked, result in unexpected high yields of olefins. The feedstock is hydroprocessed in at least one reaction zone countercurrent to the flow of a hydrogen-containing treat gas. The hydroprocessed feedstock is then subjected to thermal cracking in a steam cracker or to catalytic cracking in a fluid catalytic cracking process. The resulting product slate will contain an increase in olefin yield when compared with the same feedstock processed by conventional co-current hydroprocessing.

BACKGROUND OF THE INVENTION

Olefins, such as ethylene, propylene, butylene, and butadiene are vital to the petrochemical industry because they are the industry's basic building blocks. Consequently, there is a great demand for such olefins, and any technology that can increase olefin yield will have substantial economic value. Olefins are typically produced in steam crackers where suitable hydrocarbons are thermally cracked to produce lighter products, particularly ethylene. Typical stream cracker feedstocks range from gaseous paraffins to naphtha and gas oils. In steam cracking, the hydrocarbons are pyrolyzed in the presence of steam in tubular metal coils within furnaces. Steam acts as a diluent and the hydrocarbon cracks to produce olefins, diolefins, and other by-products. Thermal conversion in steam crackers is limited, among other things, by coking in the tubular metal coils. Typical steam cracking processes are described in U.S. Pat. Nos. 3,365,387 and 4,061,562 and in an article entitled "Ethylene" in Chemical Week, Nov. 13, 1965, pp. 69–81, all of which are incorporated herein by reference.

Olefins can also be produced in fluid catalytic cracking process units. In fact, many petroleum refiners are adjusting their fluid catalytic crackers to produce more olefins, at the expense of gasoline, to meet market demand. Fluid catalytic cracking employs a catalyst in the form of very fine particles which behave like a fluid when aerated with a vapor. The fluidized catalyst is continuously circulated between a reactor and a regenerator and serves as a vehicle to transfer heat from the regenerator to the feed and to the reactor. Most fluid catalytic crackers today use relatively active zeolitic catalysts which are so active that a minimum catalyst bed is maintained and most of the reactions take place in a riser, or transfer line, from the regenerator to the reactor. Further, catalysts with improved selectivity to high value light olefins are continuing to be commercialized.

It has been found, by the inventors hereof, that increasing the hydrogen content of heavy feeds is directly related with reduced tar yields in a steam cracker and reduced coke-make in a fluid catalytic reactor, resulting in a higher production of olefins, especially ethylene in both. Non-limiting examples of such feeds include vacuum gas oil (VGO), atmospheric gas oil (AGO), heavy atmospheric gas oil (HAGO), steam cracked gas oil (SCGO), deasphalted oil (DAO), light cat cycle oil (LCCO), vacuum resid, and atmospheric resid. Such streams can undergo catalytic hydroprocessing to remove heteroatoms such as sulfur, nitrogen, and oxygen, and to hydrogenate aromatics before being introduced into a steam cracker or fluid catalytic cracker.

Catalytic hydroprocessing is an important refinery process owing to ever stricter governmental regulations concerning environmentally harmful sulfur and nitrogen constituents in petroleum streams. Another desirable effect of hydroprocessing is the saturation and mild hydrocracking of aromatics in the feed, particularly polynuclear aromatics. The removal of heteroatoms from petroleum feedstocks is often referred to as hydrotreating and is highly desirable because there is less need for extensive separation facilities downstream of the cracker process unit when the heteroatom level is low. Further, heteroatoms such as sulfur and nitrogen, are known catalyst poisons. Typically, catalytic hydroprocessing of liquid-phase petroleum feedstocks is carried out in co-current reactors in which both the preheated liquid feedstock and a hydrogen-containing treat gas are introduced to the reactor at a point, or points, above one or more fixed beds of hydroprocessing catalyst. The liquid feedstock, any vaporized hydrocarbons, and hydrogen-containing treat gas all flow in a downward direction through the catalyst bed(s). The resulting combined vapor phase and liquid phase effluents are normally separated in a series of one or more separator vessels, or drums, downstream of the reactor. The recovered liquid stream will typically still contain some light hydrocarbons, or dissolved product gases, some of which, such as $H_2S$ and $NH_3$, can be corrosive. The dissolved gases are normally removed from the recovered liquid stream by gas or steam stripping in yet another downstream vessel or vessels, or in a fractionator.

Conventional co-current catalytic hydroprocessing has met with a great deal of commercial success, however, it has limitations. For example, because of hydrogen consumption and treat gas dilution by light reaction products, hydrogen partial pressure decreases between the reactor inlet and outlet. At the same time, any hydrodesulfurization or hydrodenitrogenation reactions that take place results in increased concentrations of $H_2S$, and/or $NH_3$. Both $H_2S$ and $NH_3$ strongly inhibit the catalytic activity and performance of most hydroprocessing catalysts through competitive adsorption onto the catalyst. Thus, the downstream portion of catalyst in a trickle bed reactor are often limited in reactivity because of the simultaneous occurrence of multiple negative effects, such as low $H_2$ partial pressure and the presence of the high concentrations of $H_2S$ and $NH_3$. Further, liquid phase concentrations of the targeted hydrocarbon reactants are also the lowest at the downstream part of the catalyst bed. Also, because kinetic and thermodynamic limitations can be severe, particularly at deep levels of sulfur removal, higher reaction temperatures, higher treat gas rates, higher reactor pressures, and often higher catalyst volumes are required. Multistage reactor systems with stripping of $H_2S$ and $NH_3$ between reactors and additional injection of fresh hydrogen-containing treat gas are often employed, but they have the disadvantage of being equipment intensive processes.

Another type of hydroprocessing is countercurrent hydroprocessing which has the potential of overcoming many of these limitations, but is presently of very limited commercial use today. U.S. Pat. No. 3,147,210 discloses a two stage process for the hydrofining-hydrogenation of high-boiling aromatic hydrocarbons. The feedstock is first subjected to catalytic hydrofining, preferably in co-current flow with hydrogen, then subjected to hydrogenation over a sulfursensitive noble metal hydrogenation catalyst countercurrent to the flow of a hydrogen-containing treat gas. U.S. Pat. Nos. 3,767,562 and 3,775,291 disclose a countercurrent process for producing jet fuels, whereas the jet fuel is first hydrodesulfurized in a co-current mode prior to two stage countercurrent hydrogenation. U.S. Pat. No. 5,183,556 also discloses a two stage co-current/countercurrent process for hydrofining and hydrogenating aromatics in a diesel fuel stream.

U.S. Pat. No. 4,619,757 teaches a two stage process for the production of olefins from heavy hydrocarbon feedstocks wherein the feedstock is hydrotreated in a first stage followed by a subsequent thermal cracking. The first stage employs a zeolitic hydrotreating catalyst, such as a faujasite structure combined with a metal selected from groups VIB, VIIB, and VIII or the Periodic Table of the Elements. The second stage employs a conventional non-zeolitic catalyst, such as those which contain a catalytic amount of molybdenum oxide and either nickel oxide and/or cobalt oxide on a suitable catalyst support, such as alumina.

Although it is known that countercurrent hydroprocessing is more efficient than co-current hydroprocessing, and that hydrotreating can improve the value of feedstocks for thermal and catalytic cracking, it was not known that for the same level of hydrogen in the upgraded feed, a higher yield of olefins will result from a stream which is the product of a countercurrent hydroprocessing process as opposed to a co-current hydroprocessing process. Therefore, there still remains a need in the art for process improvements that will result in increased yields of olefins, particularly ethylene.

SUMMARY OF THE INVENTION

In accordance with the present invention, there is provided a process for increasing the yield of olefins from streams during cracking while decreasing the amount of tar or coke make, which process comprises hydroprocessing a feedstock in the boiling range of distillate and above, in a reactor such that the feedstock and a hydrogen-containing treat gas flow countercurrent to one another. The resulting stream, which now contains substantially less heteroatoms and more hydrogen, is passed to a cracking process selected from thermal cracking and fluid catalytic cracking.

The process of the present invention more specifically comprises reacting said feedstock in a process unit comprised:

(a) passing said feed stream to at least one countercurrent reaction zone wherein the feed stream flows countercurrent to upflowing hydrogen-containing treat gas, in the presence of one or more hydroprocessing catalysts selected from the group consisting of hydrotreating catalysts, hydrogenation catalysts, hydrocracking catalysts, and ring opening catalysts, wherein each one or more reaction zones has a non-reaction zone immediately upstream and immediately downstream therefrom;

(b) recovering a vapor phase effluent from said reaction zone in the immediate upstream non-reaction zone, which vapor phase effluent is comprised of hydrogen-containing treat gas, gaseous reaction products, and vaporized liquid reaction product, also known as light liquid product, from said reaction zone;

(c) recovering downstream from said reaction zone a liquid phase reaction product, which is a relatively heavy liquid product;

(d) passing the heavy liquid product to a cracking process unit which is selected from the group consisting of thermal cracking process units, and catalytic cracking process units wherein a vapor phase product stream is recovered containing a substantial amount of olefins.

In preferred embodiments of the present invention there is provided at least one co-current reaction zone, upstream of said countercurrent reaction zones, wherein said feed stream flows co-current to the flow of a hydrogen-containing treat gas, wherein at least one of said co-current reaction zones contains a bed of hydrotreating catalyst and is operated under hydrotreating conditions.

In other preferred embodiments of the present invention said heavy liquid product is passed to one or more downstream cocurrent reaction zones containing hydroprocessing catalysts operated at hydroprocessing conditions.

It was also discovered that the light liquid product, a stream not generated by conventional co-current hydroprocessing, has an unexpectedly high N+A value (Naphthene+Aromatic content). This high content of single ring components makes this stream a very good feed for an aromatic reformer to produce fuels or chemical streams.

BRIEF DESCRIPTION OF THE FIGURES

The sole FIGURE hereof is a graphical representation showing the unexpected olefin yield obtained by hydroprocessing a gas oil feedstock countercurrent to the flow of a hydrogen-containing treat gas compared to the same feedstock which is hydroprocessed co-current to the flow of a hydrogen-containing treat gas. The FIGURE shows that even though both the countercurrent and the co-current process streams contain the same concentration of hydrogen, the ethylene yield is unexpectedly higher for the stream which was hydroprocessed countercurrent to the flow of hydrogen-containing treat gas. Also, less severe operating conditions would be required to reach any given level of hydrogen content with a countercurrent versus co-current process. It is anticipated that, through system optimization, higher hydrogen contents (i.e., higher olefin yield and lower tar yield) than shown in this FIGURE is possible.

DETAILED DESCRIPTION OF THE INVENTION

The process of the present invention is suitable for preparing feedstocks for steam cracking or catalytic cracking to produce increased amounts of olefins. Feedstocks which may be used in the practice of the present invention are those feedstocks boiling in the distillate range and above. Typically the boiling range will be from about 175° C. to about 1015° C. Preferred are feedstocks having a boiling range of about 250° C. to about 750° C., and most preferred are gas oils boiling in the range of about 350° C. to about 600° C. Non-limiting examples of suitable feedstocks include vacuum resid, atmospheric resid, vacuum gas oil (VGO), atmospheric gas oil (AGO), heavy atmospheric gas oil (HAGO), steam cracked gas oil (SCGO), deasphalted oil (DAO), and light cat cycle oil (LCCO). Preferred are the gas oils. These feedstocks are usually treated to reduce the level of heteroatoms, such as sulfur, nitrogen, and oxygen and to increase their hydrogen content and to produce some lower boiling products. The hydrogen content is increased by hydrogenating and hydrocracking aromatics. It has been found by the inventors hereof that an increased hydrogen content in such feeds will lead to an increased yield of olefins with a decrease in tar or coke make. It has also been unexpectedly found by the inventors hereof that at the same hydrogen levels, the same feedstocks, when hydroprocessed in a countercurrent mode will result in higher olefin yields versus when hydroprocessed in a co-current mode. It was also discovered that the light liquid product, a stream not generated by conventional co-current hydroprocessing, has an unexpectedly high N+A value (Naphthene+Aromatic content). This high content of single ring components makes this stream a very good feed for an aromatic reformer to produce fuels or chemical streams.

The feedstocks of the present invention are subjected to countercurrent hydroprocessing in at least one catalyst bed, or reaction zone, wherein feedstock flows countercurrent to the flow of a hydrogen-containing treat gas. Typically, the hydroprocessing unit used in the practice of the present invention will be comprised of one or more reaction zones wherein each reaction zone contains a suitable catalyst for the intended reaction and wherein each reaction zone is immediately preceded and followed by a non-reaction zone where products can be removed and/or feed or treat gas introduced. The non-reaction zone will be an empty (with respect to catalyst) horizontal cross section of the reaction vessel of suitable height.

The feedstock will most likely contain unacceptably high levels of heteroatoms, such as sulfur, nitrogen, or oxygen. In such cases, it is preferred that the first reaction zone be one in which the liquid feed stream flows co-current with a stream of hydrogen-containing treat gas through a fixed-bed of suitable hydrotreating catalyst. The term "hydrotreating" as used herein refers to processes wherein a hydrogen-containing treat gas is used in the presence of a catalyst which is primarily active for the removal of heteroatoms, including some metals removal, with some hydrogenation activity. The term "hydroprocessing" includes hydrotreating, but also includes processes such as the hydrogenation and/or hydrocracking. Ring-opening, particularly of naphthenic rings can also be included in the term "hydroprocessing." Ring-opening is herein used to refer to a more selective form of hydrocracking where the carbon-carbon bonds been broken are predominately parts of the ring structure as opposed to breaking bonds not part of ring structures. It is to be understood that a catalyst which is primarily active for a specific hydroprocess, such as hydrotreating, hydrogenation, or hydrocracking, will also be active to a lesser extent for the other hydroprocesses. That is, a hydrotreating catalyst will also show some activity for hydrogenation and hydrocracking. The feed may have been previously hydrotreated in an upstream operation or hydrotreating may not be required if the feed stream already contains a low level of heteroatoms. It may be desirable that a more active demetalization catalyst be used if the feed stream is relatively high in metals content. That is, more active than conventional hydrotreating catalysts that typically contain some demetalization function.

Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Ni; and at least one Group VI metal, preferably Mo and W, more preferably Mo, on a high surface area support material, preferably alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same bed. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydroprocessing temperatures will be from about 100° C. to about 450° C. at pressures from about 50 psig to about 2,000 psig, or higher. If the feedstock contains relatively low levels of heteroatoms, then the co-current hydrotreating step can be eliminated and the feedstock can be passed directly to an aromatic saturation, hydrocracking, and/or ring-opening reaction zone, at least one of which will be operated in countercurrent mode.

In the case where the first reaction zone is a hydrotreating reaction zone, the liquid and vapor phase effluents from said first reaction zone will be passed to at least one downstream reaction zone where the liquid phase effluent is flowed through the bed of catalyst countercurrent to upflowing hydrogen-containing treat-gas. For example, depending on the nature of the feedstock and the desired level of upgrading for steam cracking, three or more reaction zones may be needed. The most desirable steam cracker feeds are those containing predominantly paraffins, naphthenes, and aromatics. Paraffins are preferred over naphthenes which are preferred over aromatics. Thus, the desired steam cracker feed will be one containing as low a level of aromatics and as high a level of paraffins as economically feasible. Therefore, there will be one or more downstream reaction zones which contain catalysts for achieving this goal. The downstream catalyst will be selected from the group consisting of hydrotreating catalysts, hydrocracking catalysts, aromatic saturation catalysts, and ring-opening catalysts. When only one reaction zone is present downstream of the hydrotreating reaction zone, it will preferably contain a catalyst that will do hydrocracking, aromatic saturation, or both. If it is economically feasible to produce a feed with high levels of paraffins, then the downstream zones will preferably include an aromatic saturation zone and a ring-opening zone. The following must be taken into consideration when a plurality of downstream reaction zones are used: (a) a ring-opening zone will preferably follow an aromatic saturation zone; and (b) an aromatic saturation zone will follow a hydrocracking zone if a hydrocracking zone is present.

If one of the downstream reaction zones is a hydrocracking zone, the catalyst can be any suitable conventional hydrocracking catalyst run at typical hydrocracking conditions. Typical hydrocracking catalysts are described in U.S. Pat. No. 4,921,595 to UOP, which is incorporated herein by reference. Such catalysts are typically comprised of a Group VIII metal hydrogenating component on a zeolite cracking base. The zeolite cracking bases are sometimes referred to in the art as molecular sieves, and are generally composed of silica, alumina, and one or more exchangeable cations such as sodium, magnesium, calcium, rare earth metals, etc. They are further characterized by crystal pores of relatively uniform diameter between about 4 and 12 Angstroms. It is preferred to use zeolites having a relatively high silica/alumina mole ratio between about 3 and 12, more preferably between about 4 and 8. Suitable zeolites found in nature include mordenite, stalbite, heulandite, ferrierite, dachiardite, chabazite, erionite, and faujasite. Suitable synthetic zeolites include the B, X, Y, and L crystal types, e.g., synthetic faujasite and mordenite. The preferred zeolites are those having crystal pore diameters between about 8 and 12 Angstroms, with a silica/alumina mole ratio of about 4 to 6. A particularly preferred zeolite is synthetic Y. Non-limiting examples of Group VIII metals which may be used on the hydrocracking catalysts include iron, cobalt, nickel, ruthenium, rhodium, palladium, osmium, iridium, and platinum. Preferred are platinum and palladium, with platinum being more preferred. The amount of Group VIII metal will range from about 0.05 wt. % to 30 wt. %, based on the total weight of the catalyst. If the metal is a Group VIII noble metal, it is preferred to use about 0.05 to about 2 wt. %. Hydrocracking conditions will be temperatures from about 200° to 370° C., preferably from about 220° to 330° C., more preferably from about 245° to 315° C.; liquid hourly space velocity will range from about 0.5 to 10 V/V/Hr, preferably from about 1 to 5 V/V/Hr.

Non-limiting examples of aromatic hydrogenation catalysts include nickel, cobalt-molybdenum, nickel-molybdenum, and nickel tungsten. Non-limiting examples of noble metal catalysts include those based on platinum and/or palladium, which is preferably supported on a suitable support material, typically a refractory oxide material such as alumina, silica, alumina-silica, kieselguhr, diatomaceous earth, magnesia, and zirconia. Zeolitic supports can also be used. Such catalysts are typically susceptible to sulfur and nitrogen poisoning. The aromatic saturation zone is preferably operated at a temperature from about 175° C. to about 400° C., more preferably from about 260° C. to about 360° C., at a pressure from about 300 psig to about 2,000 psig, preferably from about 750 psig to about 1,500 psig, and at a liquid hourly space velocity (LHSV) of from about 0.3 $hr.^{-1}$ to about 20 $hr.^{-1}$.

At this point, the feedstock will contain relatively low levels of heteroatoms and most of the aromatics will be saturated with at least a portion of the feed being cracked to gaseous and lower molecular weight components. Such a stream is acceptable as a feed for steam cracking. If it is desirable and economically feasible to upgrade the feedstock so that higher levels of paraffins are present, then a ring-opening step can also be used. If a ring-opening step is used, then the feedstock may be first subjected to aromatic saturation, followed by ring-opening. Because it is easier to selectively open 5-membered rings than 6-membered rings it is preferred that an isomerization step to convert six-membered rings to five-membered rings be used either prior with the ring-opening step or as part of the same step. That is, the same catalyst may function as both an isomerization catalyst as well as a ring-opening catalyst The ring-opening step can be practiced by contacting the stream, containing ring compounds, with a ring opening catalyst at suitable process conditions. Suitable process conditions include temperatures from about 150° C. to about 400° C., preferably from about 225° C. to about 350° C.; a total pressure from about 0 to 3,000 psig, preferably from about 100 to 2,200 psig; more preferably about 100 to 1,500 psig; a liquid hourly space velocity of about 0.1 to 10, preferably from about 0.5 to 5; and a hydrogen treat gas rate of 500–10,000 standard cubic feet per barrel (SCF/B), preferably 1000–5000 SCF/B.

The hydrogenation and/or ring-opening steps may be carried out more economically in some instances in a more conventional co-current trickle bed reactor downstream of the countercurrent reaction zone. The countercurrent reaction zone has significant capability to be tuned to provide the greatest final olefin yield. Parameters to allow fine tuning are the actual catalysts selected, the use of all the catalyst types in sequence (i.e. if boiling point conversion is undesirable, the hydrocracking catalyst should be omitted). The target for tuning the countercurrent reaction zone will be based on the type of feed being processed; the amount of preprocessing performed; and the exact olefin generation step that the product is to be sent to. Differences in desired feed quality for steam cracking and fluid catalytic cracking are in general well known, also, desired feed quality from steam cracker to steam cracker and fluid catalytic cracker to fluid catalytic cracker differs because of the fact that different process units have been built using different design technology.

At least one of the reaction zones downstream of an initial co-current hydrotreating reaction zone will be run in countercurrent mode. That is, the liquid hydrocarbon stream will flow downward and a hydrogen-containing gas will flow upward.

It will be understood that the treat-gas need not be pure hydrogen, but can be any suitable hydrogen-containing treat-gas. The liquid phase will typically be a mixture of the higher boiling components of the fresh feed. The vapor phase will typically be a mixture of hydrogen, heteroatom impurities, and vaporized liquid products of a composition consisting of hydrocracked light reaction products and the lower boiling components in the fresh feed. These vaporized liquid products were discovered to be enriched with single ring aromatics and one ring naphthenes. The vapor phase in the catalyst bed of the downstream reaction zone will be swept upward with the upflowing hydrogen-containing treat-gas and collected, fractionated, or passed along for further processing. It is preferred that the vapor phase effluent be removed from the non-reaction zone immediate upstream (relative to the flow of liquid effluent) of the countercurrent reaction zone. If the vapor phase effluent still contains an undesirable level of heteroatoms, it can be passed to a vapor phase reaction zone containing additional hydrotreating catalyst and subjected to suitable hydrotreating conditions for further removal of the heteroatoms. It is to be understood that all reaction zones can either be in the same vessel separated by non-reaction zones, or any can be in separate vessels. The non-reaction zones in the later case will typically be the transfer lines leading from one vessel to another. It is also within the scope of the present invention that a feedstock which already contains adequately low levels of heteroatoms fed directly into a countercurrent hydroprocessing reaction zone. If a preprocessing step is performed to reduce the level of heteroatoms, the vapor and liquid are disengaged and the liquid effluent directed to the top of a countercurrent reactor. The vapor from the preprocessing step can be processed separately or combined with the vapor phase product from the countercurrent reactor. The vapor phase product(s) may undergo further vapor phase hydroprocessing if greater reduction in heteroatom and aromatic species is desired or sent directly to a recovery system. The catalyst may be contained in one or more beds in one vessel or multiple vessels. Various hardware i.e. distributors, baffles, heat transfer devices may be required inside the vessel(s) to provide proper temperature control and contacting (hydraulic regime) between the liquid, vapors, and catalyst. Also, cascading and liquid or gas quenching may also be used in the practice of the present, all of which are well known to those having ordinary skill in the art.

In another embodiment of the present invention, the feedstock can be introduced into a first reaction zone co-current to the flow of hydrogen-containing treat-gas. The vapor phase effluent fraction is separated from the liquid phase effluent fraction between reaction zones; that is, in a non-reaction zone. The vapor phase effluent can be passed to additional hydrotreating, or collected, or further fractionated and sent to an aromatics reformer for the production of aromatics. The liquid phase effluent will then be passed to the next downstream reaction zone, which will preferably be a countercurrent reaction zone. In other embodiments of the present invention, vapor phase effluent and/or treat gas can be withdrawn or injected between any reaction zones.

It is preferred that the countercurrent flowing hydrogen treat-rich gas be cold make-up hydrogen-containing treat gas, preferably hydrogen. The countercurrent contacting of the liquid effluent with cold hydrogen-containing treat gas serves to effect a high hydrogen partial pressure and a cooler operating temperature, both of which are favorable for shifting chemical equilibrium towards saturated compounds.

The countercurrent contacting of an effluent stream from an upstream reaction zone, with hydrogen-containing treat gas, strips dissolved $H_2S$ and $NH_3$ impurities from the effluent stream, thereby improving both the hydrogen partial pressure and the catalyst performance. That is, the catalyst may be on-stream for substantially longer periods of time before regeneration is required. Further, higher sulfur and nitrogen removal levels will be achieved by the process of the present invention. It may be desirable to fractionate the liquid product, pass some on to the cracking process for the generation of olefins, and send other portions to higher value dispositions.

The resulting final liquid product will contain substantially less heteroatoms and substantially more hydrogen than the original feedstock. This liquid product stream is then either thermally or catalytically cracked to produce a product slate having a substantially higher yield of olefin product then if the product stream was obtained from co-current hydroprocessing alone with the same feedstock.

The preferred thermal cracking unit is a stream cracker wherein a hydrocarbon feedstock is thermally cracked in the presence of steam. The hydrocarbon feedstock is gradually heated in furnace tubes or coils, and the thermal cracking reaction, which on the whole is endotheirnic, takes place primarily in the hottest sections of the tubes. The temperature of the tubes is determined by the nature of the hydrocarbons to be cracked, which can range from ethane to liquefied petroleum gases to gasolines or naphthas to gas oils. For example, naphtha feeds require a higher temperature in the cracking zone than gas oils. These temperatures are imposed largely by fouling, or coking, of the furnace tubes, as well as by the kinetics of the cracking reactions. Regardless of the nature of the feedstock, the cracking temperature is always very high and typically exceeds about 700° C., but it is limited to a maximum temperature in the order of 850° C. by the conditions under which the process is carried out and by the operating complexity of the furnaces. The vapor effluent from the steam cracker is introduced into a quench/primary fractionator unit where it is quenched to stop the cracking reaction and where it is fractionated into desirable product fractions. Typical product fractions include heavy oils (340° C.+) which are recovered and at least a portion of which can be recycled. Other desirable product fractions can include a gas oil fraction and a naphtha fraction. Vapor products are sent for further processing which can include gas compression, acid gas treating, drying, acetylene/diolefin removal, etc.

Fluid catalytic cracking (FCC) is a well-known method for converting high boiling hydrocarbon feedstocks to lower boiling, more valuable products. In the FCC process, the high boiling feedstock is contacted with a fluidized bed of zeolite-containing catalyst particles in the substantial absence of hydrogen at elevated temperatures. Typical zeolites are the large unit cell zeolites, such as zeolite Y. The cracking reaction typically occurs in the riser portion of the catalytic cracking reactor. Cracked products are separated from the catalyst by means of cyclones and coked catalyst particles are steam-stripped and sent to a regenerator where coke is burned off the catalyst. The hot regenerated catalyst is then recycled to contact more high boiling feed in the riser.

The following examples are presented for illustrative purposes only and are not to be taken as limiting the present invention in any way.

Comparative Example A (Untreated Feed)

A feed was prepared consisting of a blend of heavy atmospheric and light vacuum gas oils, with the following properties:

Hydrogen Content: 12.4 wt. %

Specific Gravity: 0.896

Nitrogen Content: 1000 ppm wt

Sulfur Content: 2.3 wt. %

Boiling Range: 170–540° C.

This feed was steam cracked using a steam cracking pilot unit performing substantially equivalent to a commercial low residence time type (LRT-2 type) furace operated at a severity ($C_3^=/C_1$) of 1.3 and a selectivity ($C_2^=/C_1$) of 1.8 with a steam to hydrocarbon mass ratio of 0.43. The ethylene yield was found to be 17 wt. % with a tar yield of 34 wt. %, based on the total product slate. Tar yield is defined as the product boiling in the 274° C.+ range fluxed with product from the 232° to 274° C. boiling range to yield a product with a viscosity of 150 ssu.

Comparative Example B (One Stage Co-Current Hydrotreating)

A co-current pilot unit reactor was used which is a standard tubular fixed bed reactor immersed in an electrically heated sand bath.

The feed of Comparative Example A was hydrotreated in the co-current pilot unit with sulfided commercial hydrotreating catalyst designated Criterion 411 whose composition is identified in Criterion's Product Bulletin "CRITERION*411" dated December 1992 as a TRILOBE extrudate of alumina promoted with 14.3 wt. % molybdenum and 2.6 wt. % nickel. The surface area is reported as being 155 $m^2/g$ with a pore volume of 0.45 cc/g ($H_2O$). The hydrotreating was conducted in one reactor under the following conditions:

Temperature: 343° C.

Pressure: 575 psi

Liquid Space Velocity: 0.2/hr

Hydrogen to Oil Ratio: 1700 scf/B[1]

1—scf/B means standard cubic feet per barrel.

The product hydrogen content was increased to 13.2 wt. %. The hydrotreated feed was steam cracked in accordance with Comparative Example A and the ethylene yield was found to be 20.1 wt. % with a tar yield of 15.0 wt. %.

Comparative Example C (Co-Current Hydrotreating/Mild Hydrocracking)

The feed of Comparative Example A was hydrotreated in the co-current pilot unit of Comparative Example B using sulfided commercial Criterion C411 catalyst in one reactor (R1) and sulfided commercial Criterion Z763 catalyst in a second reactor (R2) in series with (R1), and in a ratio of 2 to 1 in volume. Z763 is reported on Criterion's Material Safety Data Sheet (MSDS) as being comprised of less than 20 wt. % tungsten oxide, less than 10 wt. % nickel oxide on zeolite., under the following conditions:

| | R1 | R2 |
|---|---|---|
| Temperature: | 365° C. | 365° C. |
| Pressure: | 558 psi | 558 psi |
| Liquid Space velocity: | 0.30/hr | 0.6 /hr |
| Hydrogen/Oil Ratio: | 1500 scf/B | 1700 scf/B (incremental) |

The hydrogen content of the feed was increased to 13.7 wt. %. The hydroprocessed feed was steam cracked in accordance with Comparative Example A and the ethylene yield was found to be 21.0 wt. % with a tar yield of 8.6 wt. %.

Comparative Example D (Deep Aromatic Saturation)

A product similar to the one described above is first stripped of $H_2S$ and $NH_3$ then processed further in the co-current pilot unit using a massive nickel aromatic saturation catalyst under the following conditions:

Temperature: 315° C.

Pressure: 1600 psi

Liquid Space Velocity: 0.2/hr

Hydrogen to Oil Ratio: 5000 scf/B

The product hydrogen content is increased to 14.3 wt. %. The hydrotreated feed was steam cracked in accordance with Comparative Example A and the ethylene yield was found to be 23.7 wt. % with a tar yield of 5.0 wt. %.

Example 1 (Counter-Current Hydroprocessing)

A countercurrent hydroprocessing pilot unit was used instead of a co-current pilot unit as was used in the above examples. The countercurrent pilot unit consisted of a tubular fixed bed reactor heated with electric furnaces wherein liquid feed is injected at the top of the reactor and hydrogen is fed at the bottom of said reactor. Heavy liquid products exits the reactor at the bottom. Gases including vaporized light liquid product exit the reactor at the top.

The feed of Comparative Example A was hydrotreated in the counter-current pilot unit using sulfided commercial Criterion C411 catalyst in the top ⅔ of the reactor with sulfided commercial Criterion Z763 catalyst in bottom third of the reactor. When reactor conditions are:

Reactor Temperature: 343° C.

Pressure: 558 psi

First Reactor Liquid Space Velocity: 0.17/hr

Hydrogen to Oil Ratio: 5000 scf/B

The heavy liquid product hydrogen content is increased to 13.5 wt. %. The hydrotreated feed was steam cracked in accordance with Comparative Example A and the ethylene yield was found to be 24.0 wt. % with a tar yield of 10.0 wt. %. The light liquid product has an N+A value (naphthene+aromatic content) of 77 wt. %. The heavy liquid product was also distilled into four boiling range fractions: 91° C. to 177° C., 177° C. to 260° C., 260° C. to 343° C., and 343° C.+. The aromatic contents of these streams were measured and found to be 19 wt. %, 30 wt. %, 21 wt. %, and 11 wt. % respectfully; this atypically skewed distribution of aromatics across the boiling range of the total product gives the potential for further olefin generation improvement. While steam cracking yields were not determined for these distilled fractions, it is generally known by those skilled in the art that lower aromatic content streams are the preferred choice for higher olefin yields in cracking processes. Distillation of the heavy liquid product into various boiling ranges with some going to the cracking process and other fractions going to alternate dispositions is a means by which an integrated site could optimize the volume and cost of produced olefins.

Example 2 (Counter-Current Hydroprocessing)

For the same reactor and feed in Example 1, the operating severity was increased to the following reactor conditions:

Reactor Temperature: 354° C.

Pressure: 558 psi

First Reactor Liquid Space Velocity: 0.09/hr

Hydrogen to Oil Ratio: 5000 scf/B

The heavy liquid product hydrogen content is increased to 14.1 wt. %. The hydrotreated feed was steam cracked in accordance with Comparative Example A and the ethylene yield was found to be 27.0 wt. % with a tar yield of 6.0 wt. %. The light liquid product has an N+A value (naphthene+aromatic content) of 67 wt. %.

What is claimed is:

1. A process for increasing the yield of olefins from a gas oil boiling range feed stream during cracking which process comprises:

(a) passing said feed stream to an initial countercurrent reaction zone wherein the feed stream flows countercurrent to upflowing hydrogen-containing treat gas, in the presence of one or more hydrotreating catalysts, wherein said initial countercurrent reaction zone has a non-reaction zone immediately upstream and immediately downstream therefrom;

(b) passing the liquid and vapor phase effluents from said initial reaction zone to a second countercurrent reaction zone downstream from said initial reaction zone in the presence of one or more hydrocracking catalysts, wherein said second countercurrent reaction zone has a non-reaction zone immediately upstream and immediately downstream therefrom;

(c) recovering a vapor phase effluent from said second reaction zone in the immediate upstream non-reaction zone, which vapor phase effluent contains hydrogen-containing treat gas, gaseous reaction products, and a vaporized liquid reaction product;

(d) recovering downstream from said initial reaction zone a heavy liquid product; and (e) passing the heavy liquid product to a cracking process unit which is selected from the group consisting of thermal cracking process units, and catalytic cracking process units wherein a vapor phase product stream is recovered comprising olefins.

2. The process of claim 1 wherein there is provided at least a first co-current reaction zone, upstream of said initial countercurrent reaction zone, wherein said feed stream flows co-current to the flow of a hydrogen-containing treat gas, wherein said first co-current reaction zone comprises a bed of hydrotreating catalyst and is operated under hydrotreating conditions.

3. The process of claim 1 wherein said heavy liquid product is passed to one or more downstream cocurrent reaction zones comprising hydroprocessing catalysts operated at hydroprocessing conditions.

4. The process of claim 2 wherein said second countercurrent reaction zone additionally includes one or more aromatic saturation catalysts.

5. The process of claim 2 wherein said second countercurrent reaction zone consists of a bed of aromatic saturation catalyst.

6. The process of claim 4 wherein there is provided a third countercurrent reaction zone comprising a bed of hydrogenation catalyst downstream of said second countercurrent reaction zone comprising hydrocracking catalyst.

7. The process of claim 5 wherein there is provided a third countercurrent reaction zone comprising a bed of hydrogenation catalyst downstream of said second countercurrent reaction zone comprising aromatic saturation catalyst.

8. The process of claim 4 wherein there is provided a third countercurrent reaction zone downstream of said second countercurrent reaction zone comprising aromatic saturation catalyst, which said third countercurrent reaction zone comprises a bed of ring-opening catalyst.

9. The process of claim 5 wherein there is provided a third countercurrent reaction zone downstream of said second countercurrent reaction zone comprising hydrocracking catalyst, which said third countercurrent reaction zone comprises a bed of ring-opening catalyst.

10. The process of claim 1 wherein, downstream of all reaction zones, said vaporized liquid reaction product is condensed and combined with said heavy liquid product and sent to a cracking process unit.

11. The process of claim 2, wherein, downstream of all reaction zones, said vaporized liquid reaction product is condensed and combined with said heavy liquid product and sent to a cracking process unit.

12. The process of claim 1 wherein said heavy liquid product is fractionated and at least a portion sent to a cracking process unit.

13. The process of claim 2 wherein said heavy liquid product is fractionated and at least a portion sent to a cracking process unit.

14. The process of claim 1 wherein said vaporized liquid product sent to a reformer process unit.

15. The process of claim 2 wherein said vaporized liquid product sent to a reformer process unit.

16. The process of claim 1 wherein said thermal cracking process unit is a steam cracking process unit.

17. The process of claim 2 wherein said thermal cracking process unit is a steam cracking process unit.

18. The process of claim 1 wherein said catalytic cracking process unit is a fluidized catalytic cracking process unit.

19. The process of claim 2 wherein said catalytic cracking process unit is a fluidized catalytic cracking process unit.

20. A process for increasing the yield of olefins from a gas oil boiling range feed stream during cracking which process comprises:

(a) passing said feed stream to an initial countercurrent reaction zone wherein the feed stream flows countercurrent to upflowing hydrogen-containing treat gas, in the presence of one or more hydrotreating catalysts, wherein said initial countercurrent reaction zone has a non-reaction zone immediately upstream and immediately downstream therefrom;

(b) passing the liquid and vapor phase effluents from said initial reaction zone to a second countercurrent reaction zone downstream from said initial reaction zone in the presence of one or more catalysts selected from the group consisting of hydrocracking catalysts and aromatic saturation catalysts, wherein said second countercurrent reaction zone has a non-reaction zone immediately upstream and immediately downstream therefrom;

(c) recovering a vapor phase effluent from said second reaction zone in the immediate upstream non-reaction zone, which vapor phase effluent contains hydrogen-containing treat gas, gaseous reaction products, and a vaporized liquid reaction product;

(d) recovering downstream from said initial reaction zone a heavy liquid product; and (e) passing the heavy liquid product to a cracking process unit which is selected from the group consisting of thermal cracking process units, and catalytic cracking process units wherein a vapor phase product stream is recovered comprising olefins;

wherein said liquid phase reaction product is passed to one or more downstream cocurrent reaction zones comprising hydroprocessing catalysts operated at hydroprocessing conditions; and wherein, downstream of all reaction zones, said vaporized liquid reaction product is condensed and combined with said heavy liquid product and sent to a cracking process unit.

* * * * *